US007117616B2

(12) United States Patent
Hull

(10) Patent No.: US 7,117,616 B2
(45) Date of Patent: Oct. 10, 2006

(54) FOOTWEAR AND OTHER FOOT-RECEIVING DEVICES INCLUDING A REMOVABLE CLOSURE SYSTEM COVER MEMBER

(75) Inventor: N. Scot Hull, Battle Ground, WA (US)

(73) Assignee: NIKE, Inc., Beaverton, OR (US)

( * ) Notice: Subject to any disclaimer, the term of this patent is extended or adjusted under 35 U.S.C. 154(b) by 185 days.

(21) Appl. No.: 10/781,328

(22) Filed: Feb. 19, 2004

(65) Prior Publication Data

US 2005/0183288 A1 Aug. 25, 2005

(51) Int. Cl.
*A43B 23/00* (2006.01)

(52) U.S. Cl. ..... 36/136; 36/54

(58) Field of Classification Search ..... 36/136, 36/54, 50.1, 100, 101, 99, 72 R, 133
See application file for complete search history.

(56) References Cited

U.S. PATENT DOCUMENTS

| | | | | | |
|---|---|---|---|---|---|
| 2,022,554 | A | | 11/1935 | Williams | |
| 2,182,835 | A | * | 12/1939 | Zapis | 24/713.1 |
| 3,822,489 | A | * | 7/1974 | Johnson | 36/100 |
| 4,065,861 | A | | 1/1978 | Pelfrey | |
| 4,126,951 | A | * | 11/1978 | Antonious | 36/54 |
| 4,254,566 | A | | 3/1981 | Haskell | |
| 4,377,913 | A | * | 3/1983 | Stone | 36/99 |
| 4,406,073 | A | | 9/1983 | Spademan | |
| 4,597,198 | A | | 7/1986 | Schweitzer | |
| 4,630,383 | A | * | 12/1986 | Gamm | 36/136 |
| 4,766,682 | A | | 8/1988 | Malloy, III | |
| 4,805,321 | A | | 2/1989 | Tonkel | |
| 4,823,426 | A | | 4/1989 | Bragga | |
| 4,879,787 | A | | 11/1989 | Walls | |
| 5,165,190 | A | | 11/1992 | Smyth | |
| 5,459,947 | A | | 10/1995 | Lasher | |
| 5,564,203 | A | * | 10/1996 | Morris | 36/50.1 |
| 5,566,477 | A | | 10/1996 | Mathis et al. | |
| 5,673,499 | A | | 10/1997 | Attilieni | |
| 5,701,688 | A | | 12/1997 | Crowley | |
| 5,778,564 | A | | 7/1998 | Kettner | |
| 5,848,484 | A | | 12/1998 | Dupree et al. | |
| 5,979,085 | A | | 11/1999 | Ross et al. | |
| 6,000,111 | A | | 12/1999 | Deskins et al. | |
| 6,212,797 | B1 | | 4/2001 | Merry et al. | |
| 6,321,466 | B1 | | 11/2001 | Bordin et al. | |
| 6,338,186 | B1 | | 1/2002 | Kleinmann | |
| D456,121 | S | | 4/2002 | Smith, III | |
| 6,397,497 | B1 | | 6/2002 | McAtee | |
| 6,408,542 | B1 | * | 6/2002 | Shepherd | 36/54 |
| 6,449,881 | B1 | * | 9/2002 | Assaf et al. | 36/136 |
| D472,041 | S | | 3/2003 | Kuerbis | |

(Continued)

*Primary Examiner*—Marie Patterson
(74) *Attorney, Agent, or Firm*—Banner & Witcoff, Ltd

(57) ABSTRACT

Foot-receiving devices, such as athletic or other footwear, may be modified to provide different aesthetic looks. Such foot-receiving devices may include: a housing member at least partially defining a foot-receiving chamber; a closure system for at least partially holding the foot in the chamber; a tongue member located between at least a portion of the closure system and the foot, the tongue member including a first engagement element; and a cover member for at least partially covering the closure system, the cover member including a second engagement element that engages with the first engagement element to removably engage the cover member with the tongue member. The user can freely engage or disengage the cover member to change the aesthetic appearance of the device, e.g., depending on personal preference.

34 Claims, 4 Drawing Sheets

U.S. PATENT DOCUMENTS 6,574,887 B1 6/2003 Jones et al.
6,601,323 B1 8/2003 Tsujino et al.
6,895,696 B1 * 5/2005 Sanders ..... 36/54

* cited by examiner

FOOTWEAR AND OTHER FOOT-RECEIVING DEVICES INCLUDING A REMOVABLE CLOSURE SYSTEM COVER MEMBER

FIELD OF THE INVENTION

Aspects of the present invention generally relate to footwear and other foot-receiving devices that may be modified to provide different aesthetic looks, e.g., depending on a user's personal preferences. In at least some examples, a foot-receiving device according to the invention will include a closure system cover member that removably engages with a tongue member to enable a change in the aesthetic appearance of the foot-receiving device.

BACKGROUND

Many conventional and well known footwear product designs, and particularly athletic footwear product designs, include an extended tongue flap. For example, traditional baseball shoe or cleat designs and golf shoe or spike designs often include an extended tongue flap that folds over the shoe's laces. Originally, this tongue flap was included to protect the laces and to prevent dirt and other matter from damaging the laces and/or entering the shoe, e.g., when the wearer slides into a base and/or steps into a sand trap. Footwear including this extended tongue flap has become a traditional design for many footwear products.

Not all people, however, like this traditional design, believing it to be "old-fashioned," and they prefer a more "modern" look (i.e., one without the extended tongue flap). Because products including the traditional design included the extended tongue flap as an integral and unremovable part of the tongue structure, the flap typically could not be removed without damaging the shoe, without damaging the shoe's appearance, and/or without expending considerable time, effort, and/or expense. Moreover, by producing footwear products that either included an extended tongue flap or did not include the tongue flap, each product typically was desired by and salable to only a portion of the potential market.

Accordingly, it would be advantageous to provide a footwear product that includes an easily detachable cover member for the closure system, akin in appearance to a traditional tongue flap extension or other tongue flap extension design, that would allow consumers to easily and securely include the cover member with the tongue if it is desired, to easily change cover members, if desired, and/or to easily remove the cover member from the product if it is not desired.

SUMMARY

Aspects of the present invention relate to foot-receiving devices that may be modified to provide different aesthetic looks, e.g., depending on a user's personal preferences. Foot-receiving devices according to at least some examples of the invention may include, for example: a housing member at least partially defining a chamber for receiving a foot; a closure system for at least partially holding the foot in the chamber; a tongue member located between at least a portion of the closure system and the foot when the foot is held in the housing member, wherein the tongue member includes a first engagement element; and a cover member for at least partially covering the closure system, wherein the cover member includes a second engagement element that engages with the first engagement element of the tongue member to removably engage the cover member with the tongue member. In some more specific examples, the first engagement element may include a pocket and the second engagement element may be at least partially slidably receivable in the pocket. The pocket may be defined in or included on or as part of the tongue member, and the slidable engagement element of the tongue member may be included as part of the cover member, or vice versa. Additionally, in at least some more specific examples of the invention, the cover member further may include: a cover element that extends from the second engagement element, wherein the cover element includes a free end that extends to at least partially cover the closure system; a fastener arrangement that releasably secures to the tongue member; and/or a first securing mechanism that releasably engages with and/or secures to at least a portion of the closure system.

In at least some examples of the invention, the foot-receiving device may be a piece of footwear, such as a shoe (e.g., an athletic shoe). Footwear according to at least some examples of the invention may include: a sole member; an upper extending from the sole member, wherein the upper at least partially defines a chamber for receiving a foot; a closure system for at least partially holding the foot in the chamber; a tongue member located between at least a portion of the closure system and the foot when the foot is held in the chamber; and a cover member for at least partially covering the closure system. The tongue member and/or the cover member may have characteristics or features like those described above.

Additional aspects of the invention relate to methods relating to use and/or configuration of the foot-receiving devices (including the footwear) described above. Such methods may include, for example: providing a foot-receiving device including a housing member that at least partially defines a chamber for receiving a foot, a closure system, and a tongue member; removably engaging a first engagement element of the tongue member with a second engagement element provided with a cover member for the closure system; and placing a cover element of the cover member over at least a portion of the closure system to thereby at least partially cover the closure system. Again, the tongue member and/or the cover member may have the construction and operation generally described above.

BRIEF DESCRIPTION OF THE DRAWINGS

The above and other objects, features, and advantages of the present invention will be more readily apparent and more fully understood from the following detailed description, taken in conjunction with the appended drawings, in which.

DETAILED DESCRIPTION

Figure 1:
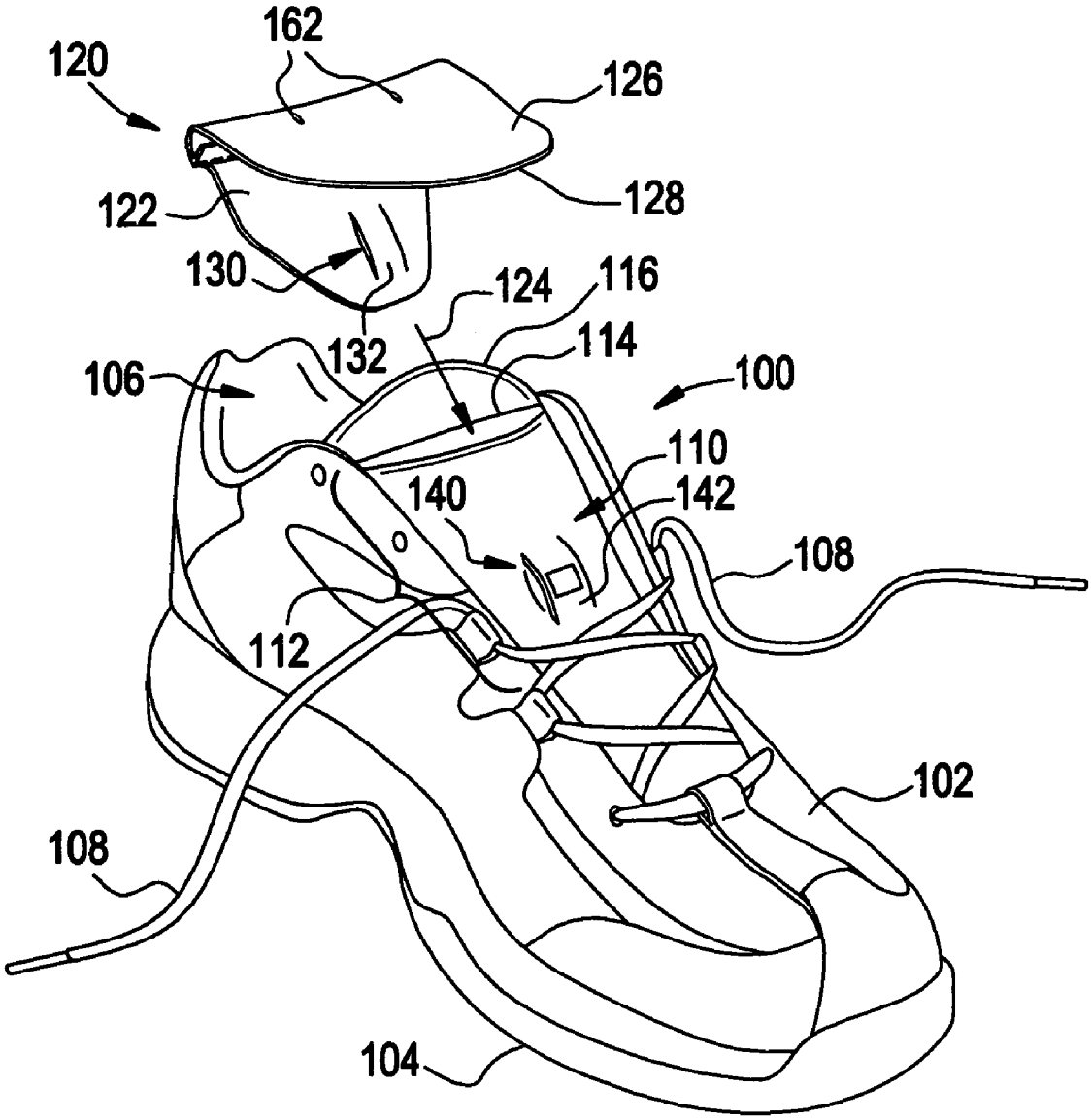
FIG. 1 illustrates an exploded view of an example piece of footwear in accordance with aspects of the present invention that includes a removable closure system cover member.

Various specific examples of the invention are described in detail below in conjunction with the attached drawings. To assist the reader, this specification is broken into various subsections, as follows: Terms; General Description of Foot-Receiving Devices and Methods in Accordance with Examples of the Invention; Specific Examples of the Invention; and Conclusion.

A. Terms

The following terms are used in this specification, and unless otherwise noted or clear from the context, these terms have the meanings provided below.

"Foot-receiving device" means any device into which a user places at least some portion of his or her foot. In addition to all types of footwear (described below), foot-receiving devices include, but are not limited to: bindings and other devices for securing feet in snow skis, cross country skis, water skis, snowboards, and the like; bindings, clips, or other devices for securing feet in pedals for use with bicycles, exercise bikes, games, and the like; bindings, clips, or other devices for receiving feet during play of video games; and the like.

"Footwear" means any type of wearing apparel for the feet, and this term includes, but is not limited to: all types of shoes, boots, sneakers, sandals, thongs, flip-flops, mules, scuffs, slippers, sport-specific shoes (such as golf shoes, ski boots, baseball shoes, cleated shoes, etc.), and the like.

B. General Description of Foot-receiving Devices and Methods in Accordance with Examples of the Invention In general, aspects of this invention relate to foot-receiving devices, such as athletic footwear or other footwear, that may be freely modified (e.g., by the ultimate end user) to change their aesthetic appearance in certain ways. For example, traditional baseball and golf shoes often include a flap or extension of material integrally formed as part of the shoe's tongue. Once the shoe is tied (or otherwise secured on the wearer's foot), this flap or extension folds over to at least partially cover the laces (or other shoe closure element). While some users like the traditional aesthetic appearance of this lace covering flap, others do not.

Aspects of the present invention allow users, including the ultimate end users, to freely determine whether to include a closure system cover member on their footwear or other foot-receiving devices by providing a removable cover member for the closure system. While the cover members provided and/or used in at least some examples of the invention are readily engageable and disengageable from the foot-receiving devices, the cover members, nonetheless, may be securely and reliably fastened to the foot-receiving devices when their use is desired.

Foot-receiving devices in accordance with at least some examples of the present invention include: a housing member at least partially defining a chamber for receiving a foot; a closure system for at least partially holding the foot in the chamber; a tongue member located between at least a portion of the closure system and the foot when the foot is held in the housing member, wherein the tongue member includes a first engagement element; and a cover member for at least partially covering the closure system, wherein the cover member includes a second engagement element that engages with the first engagement element to removably engage the cover member with the tongue member. At least one of the first or second engagement elements may include a pocket (e.g., defined in or formed on the tongue member or the cover member), and the other engagement element may constitute an extension area of appropriate size and shape to slidably fit within the pocket.

In at least some more specific examples, the pocket may be defined in or provided on the tongue member, e.g., at or near the free end of the tongue member. The pocket location, the tongue member size and shape, and/or the cover member size and shape may be selected, in at least some examples, such that at least a portion of the free end of the tongue member will remain visible when the cover member is engaged with the tongue member. If desired, the free end of the tongue may include adequate space, for example, to accommodate a logo, a brand name, a trademark, or other indicia.

Additional example aspects of the invention relate to characteristics of the cover member. In at least some examples, the cover member may include a cover element that extends from the second engagement element and is exposed as a free end when the second engagement element is engaged with the first engagement element. The free end of this cover element may extend over and at least partially cover the closure system. Additionally, if desired, in at least some examples, the cover element may be releasably secured to the outside of the tongue member, the housing member, the shoe upper, and/or the closure system, for example, by providing a first fastener element on the cover element (e.g., at or near its free end) that engages with a second fastener element provided on the tongue member, the housing member, the shoe upper, and/or the closure system. These fastener elements may constitute, for example, a hook-and-loop type fastener, a snap type fastener, a button type fastener, a hook-and-eyelet type fastener, a tab/slot type fastener, or any other desired type of fastener arrangement.

In at least some examples of the invention, the cover member also may be engaged with and/or secured to the closure system. For example, when the closure system for the foot-receiving device includes a shoe lace, the cover element may include a pair of openings defined therein, wherein a first end of the shoe lace extends through one opening of the pair and a second end of the shoe lace extends through the other opening of the pair to releasably engage the cover member with the closure system when the shoe lace is tied.

As yet another alternative or example, the cover member may be engaged with and/or secured to the closure system through the use of a securing mechanism. This securing mechanism may be provided as part of the second engagement element for the cover member. As a more specific example, in foot-receiving devices where the closure system includes a shoe lace, the securing mechanism of the cover member may include a pair of openings defined in the cover member (e.g., in the second engagement element) to thereby form a flap of material, wherein the shoe lace extends through this pair of openings and behind the flap at least one time, and in at least some examples, at least two times (e.g., when lacing the foot-receiving device, the lace also may be passed through openings and behind the flap of material provided in the cover member).

If desired, the tongue member may include a securing mechanism for securing to the closure system, and this securing mechanism may be structurally similar to or different from the securing mechanism (if any) provided with the cover member. As one more specific example, the tongue member may include a pair of openings to form a flap of material similar to that described above for inclusion on the cover member, and the shoe lace may be engaged with the pair of openings and behind the flap in the tongue member in the general manner described above. Optionally, in at least some examples, the pair of openings in the tongue member may be sized and arranged so as to be located proximate to the location of the pair of openings in the cover member in use, such that when the shoe is laced, the lace may be passed through the openings defined in the tongue member and in the cover member at the same time.

As noted above and illustrated in more detail in the attached drawings, foot-receiving devices in accordance with examples of the present invention may constitute pieces of footwear, such as athletic footwear (e.g., baseball shoes or cleats, golf shoes or spikes, etc.). In at least some examples, pieces of footwear according to the invention may include: a sole member; an upper extending from the sole member and at least partially defining a chamber for receiving a foot; a closure system for at least partially holding the foot in the upper; a tongue member located between at least a portion of the closure system and the foot when the foot is held in the upper; and a cover member for at least partially covering the closure system. The tongue member and the cover member may take on the various forms and functions, like those described in more detail above.

Additional aspects of the invention relate to various methods and/or uses of footwear and other foot-receiving devices, like those described above. Examples of such methods may include: providing a foot-receiving device (such as a piece of footwear, e.g., as described above) including a housing member that at least partially defines a chamber for receiving a foot, a closure system, and a tongue member; removably engaging a first engagement element of the tongue member with a second engagement element provided with a cover member for the closure system; and placing a cover element of the cover member over at least a portion of the closure system to thereby at least partially cover the closure system.

As generally described above, in at least some examples of the above methods, one of the first or second engagement elements may include a pocket, and the other engagement element may be constructed so as to slidably fit within the pocket. Additionally, or alternatively, if desired, the cover member may be releasably secured to the tongue member, the housing member, the shoe upper, the closure system, etc., in one or more ways, e.g., by engaging the cover element of the cover member to the outside of the tongue member, the housing member, the shoe upper, the closure system, etc., via a fastener arrangement. Additionally or alternatively, as generally described above, the cover member also may be releasably secured to the closure system, e.g., by lacing a shoe lace through openings provided in the cover element and/or in the second engagement element.

Notably, the tongue member also may be secured with the closure system in methods according to examples of the invention, as generally described above, e.g., by lacing the shoe lace through openings provided in the tongue member.

Specific examples of the invention are described in more detail below. The reader should understand that these specific examples are set forth merely to illustrate examples of the invention, and they should not be construed as limiting the invention.

C. Specific Examples of the Invention

The various figures in this application illustrate examples of foot-receiving devices and their use in accordance with examples of this invention. When the same reference number appears in more than one drawing, that reference number is used consistently in this specification and the drawings to refer to the same part throughout.

FIG. 1 illustrates an example foot-receiving device in accordance with aspects of the present invention. In the illustrated example, the foot-receiving device is a piece of footwear 100, and more specifically, an athletic shoe. The piece of footwear 100 includes an upper member 102 attached to a sole member 104 in any manner, for example, by sewing, adhesives, and/or any other suitable manner, including in conventional manners known in the art. As such, the upper member 102 and/or the sole member 104 form a housing with an open end, thereby defining an open chamber 106 for receiving a wearer's foot.

In at least some examples, the sole member 104 may include spikes or cleats, for example, like those conventionally provided on golf, baseball, football, soccer and/or other athletic shoes. Additionally, the upper member 102 and the sole member 104 may be of a generally conventional construction as is known in the art, for example, including a conventional closure mechanism or system, cushioning or foot comfort elements, an outsole, a midsole, an insole, etc. Additionally, the various portions of the upper member 102 and the sole member 104 may be constructed from any suitable or desired materials including conventional materials known and used in the art, such as leather, plastic, polymeric materials, nylon, rubber, and/or other natural or synthetic materials.

The piece of footwear 100 further may include one or more closure systems for at least partially holding the foot in the chamber 106. Any desired closure system structure may be used without departing from the invention, including conventional closure systems known in the art, such as laces, buckles, zippers, hook-and-loop fasteners, etc. In the illustrated example, the closure system includes a shoe lace 108 engaged in a plurality of eyelets and/or other lace engaging elements provided in the upper member 102 in a conventional manner as known in the art.

As illustrated in FIG. 1, a tongue member 110 is provided between the closure system and the foot-holding chamber 106. As is known in the art, utilization of a tongue member 106 allows the opening to the foot-holding chamber 106 to be widen sufficiently to easily receive the foot (e.g., by loosening the lace 108), and when the lace 108 (or other closure system) is tightened down to hold the foot in the chamber 106, the tongue member 110 provides cushion between the closure system and the foot to improve the wearer's comfort.

The tongue member 110 in the illustrated example includes an engagement element, which in the illustrated example is in the form of a pocket 112. The pocket 112 of this example is formed on or defined at the outer surface of the tongue member 110, and the pocket 112 has an open end portion 114 provided at or near the free end 116 of the tongue member 110. While the open end 114 may be provided at any desired location on the tongue member, in at least some examples, the open end 114 will be provided within 20% of the free end 116 of the tongue member 110 (based on a total length of the tongue member). In the illustrated example, the open end 114 of the pocket 112 is provided within 10% of the free end 116 of the tongue member 110 (based on the total length of the tongue member), and in some instances, if desired, it may be within 5% of the free end 116 or even at the free end 116.

The pocket 112 may be formed as part of the tongue member 110 in any suitable manner without departing from the invention. For example, the pocket 112 may be formed by sewing or otherwise attaching a flap or piece of material to a base member forming part of the tongue member 110. As another example, the tongue member 110 may be formed so as to include an interior chamber, and the pocket 112 may be formed by providing a slit in the tongue member 110 that extends from the exterior of the tongue member 110 to its interior chamber. The open end portion 114 may be located at any suitable position with respect to the remainder of the tongue member 110, and the opening 114 and/or the pocket 112 may be of any suitable or desired size, shape, or dimensions without departing from the invention. Optionally, if desired, the pocket 112 may be formed as a flap or piece of material that extends across the tongue member 110 with both an open top and bottom (e.g., the flap of material could be stitched in the longitudinal direction along or near the lateral sides of the tongue member 110 while the top and bottom sides of the flap (as viewed in the tongue member's longitudinal direction) are left open).

The piece of footwear 100 in accordance with aspects of the present invention further includes a cover member 120 for at least partially covering the closure system. In the illustrated example, the cover member 120 includes an engagement element 122 that removably or releasably engages with the engagement element provided in the tongue member 110 (e.g., with the pocket 112) to removably attach the cover member 120 to the tongue member 110. The engagement element 122 in the illustrated example is a slide element that is sized and positionable so as to slidably fit into the pocket 112 defined in the tongue member 110. The slidable fit is illustrated in FIG. 1 by arrow 124. Of course, other ways of removably engaging the cover member 120 with the tongue member 110 are possible without departing from the invention. For example, the cover member 120 may include plural engagement elements or tabs that fit into one or more pockets or slots formed in the tongue member 110, and vice versa. As another example, snap mechanisms, hook-and-loop type fasteners, buttons, and/or other appropriate fastening elements may be provided on the tongue member 110 and/or the cover member 120 to allow releasable engagement of these two members.

The cover member 120 of the illustrated example further includes a cover element 126 integrally formed with and extending from the engagement element 122. The cover element 126 at least partially covers the closure system. In the illustrated example, the free end 128 of the cover element 126 will extend over and cover at least a portion of the shoe lace 108 and the opening to the chamber 106 when engaged with the tongue member 110. If desired, the engagement element 122 may include a stiffening material, such as an additional stiff backing layer or material, so that the engagement element 122 is stiffer and more rigid than the cover element 126. The inclusion of this stiffening material can help the engagement element 122 maintain its shape and make it more easily insertable into the pocket 112.

Figure 2:
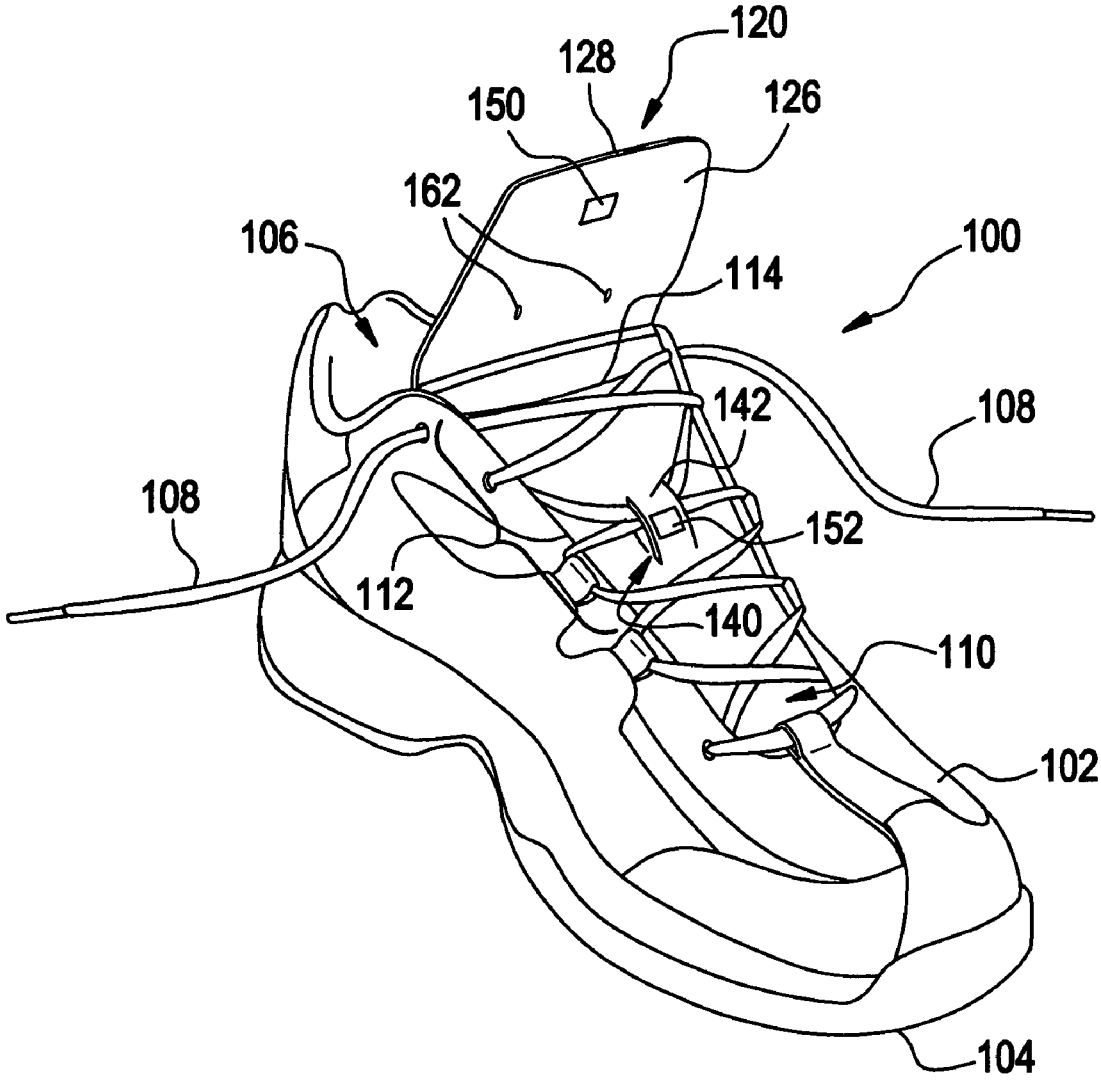
FIG. 2 illustrates a view of the example piece of footwear of FIG. 1 with the cover member engaged with the tongue member and flipped upward to allow access to the closure system.

Additionally, as illustrated in FIG. 1, in at least some examples of the invention, the engagement element 122 of the cover member 120 may include a securing mechanism 130 that enables the cover member 120 to be releasably engaged with the closure system. In the illustrated example, the securing mechanism 130 takes on the form of two slits through the engagement element 122 to thereby define a flap of material 132. Once engaged with the tongue member 110 by sliding the engagement element 122 into the pocket 112, as illustrated in FIG. 2, the shoe lace 108 may be passed through the slits and behind the flap 132 of the securing mechanism 130, optionally one or more times, to thereby engage the cover member 120 with the closure system's shoe lace 108.

To allow shoe lace 108 access to the securing mechanism 130 (e.g., flap 132) of the cover member 120 when the cover member 120 is engaged with the tongue member 110, the pocket 112 and/or the tongue member 110 may include an opening defined therein at the location of the securing mechanism 130. As another alternative, the pocket 112 may include a second open end, as mentioned above, such that the lower end of the engagement element 122, including the flap 132 or other securing mechanism 130, extends out of the bottom of the pocket 112 and therefore is exposed for engagement by the shoe lace 108.

Alternatively, or additionally, the tongue member 110 also may include a securing mechanism 140 that releasably or removably attaches to at least a portion of the closure system. In the illustrated example, the securing mechanism 140 may take on the form of two slits in the material of the tongue member 110, optionally in the outer material of the tongue member 110 and/or the pocket member 112, to thereby define a flap of material 142. As illustrated in FIG. 2, the shoe lace 108 may be passed through the slits and behind the flap 142 of the securing mechanism 140, optionally one or more times, to thereby engage the tongue member 110 with the closure system's shoe lace 108. Optionally, as shown in FIG. 2, when the cover member 120 is engaged with the tongue member 110, the securing mechanism 130 of the cover member 120 may be located adjacent to the securing mechanism 140 of the tongue member 110, such that the shoe lace 108 may be made to pass through the slits in both members and behind the flaps 132 and 142 at essentially the same time and/or at essentially the same locations. Alternatively, if desired, the securing mechanisms 130 and 140 may be located at different, independent locations.

The cover element 126 of the cover member 120 also may releasably engage with the tongue member 110, for example, at an exterior of the tongue member 110 and/or the pocket 112. In some instances, the cover element 126 may releasably engage with a portion of the shoe's upper 102, the closure system, or other appropriate element of the footwear 100. In the illustrated example, the underside of the cover element 126 may include a fastening element 150, e.g., located toward the free end 128 of the cover element 126. This fastening element 150 may engage with a corresponding fastening element 152 provided on the tongue member 110. Of course, the various fastening elements 150 and 152 may be located at any desired position on the tongue member 110 and the cover member 120 (or other portions of the shoe) without departing from the invention. When engaged, as illustrated in FIG. 3, the cover element 126 is removably engaged and fixed over at least a portion of the tongue member 110 and over at least a portion of the closure system.

Any suitable or desired fastening elements 150 and/or 152 may be used without departing from the invention. For example, hook-and-loop type fasteners, snap fasteners, hook-and-eyelet type fasteners, one or more buttons, and the like may be used without departing from the invention. As another example, the cover element 126 may include a strap, tab, or extension (e.g., extending past the free end 128) that fits into a slot or pocket defined in the tongue member 110, or vice versa, without departing from the invention.

Figure 3:
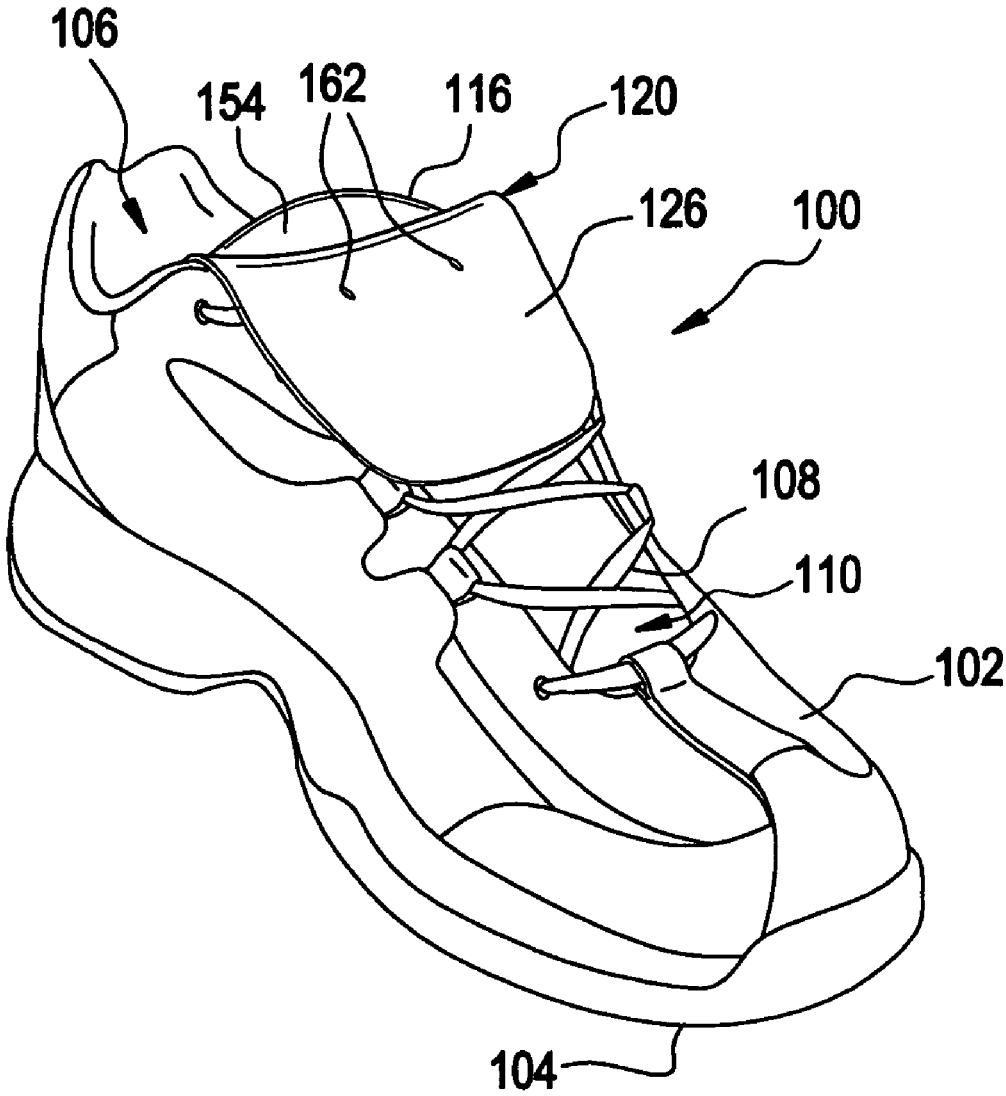
FIG. 3 illustrates a view of the example piece of footwear of FIGS. 1 and 2 with the cover member engaged with the tongue member and flipped downward to cover at least a portion of the footwear's closure system.

As shown in FIG. 3, in at least some examples of the invention, the tongue member 110 and the cover member 120 may be designed such that when the cover member 120 is engaged with the tongue member 110, at least a portion of the free end 116 of the tongue member 110 may remain externally visible. If desired, this free end 116 may include an indicia panel 154 for placement of any suitable or desired indicia, such as a trademark, trade name, logo, model number, or the like. Alternatively, if desired, the tongue member 110 and cover member 120 may be designed such that the free end 116 of the tongue member 110 remains beneath the cover member 120 and is not readily visible.

Figure 4:
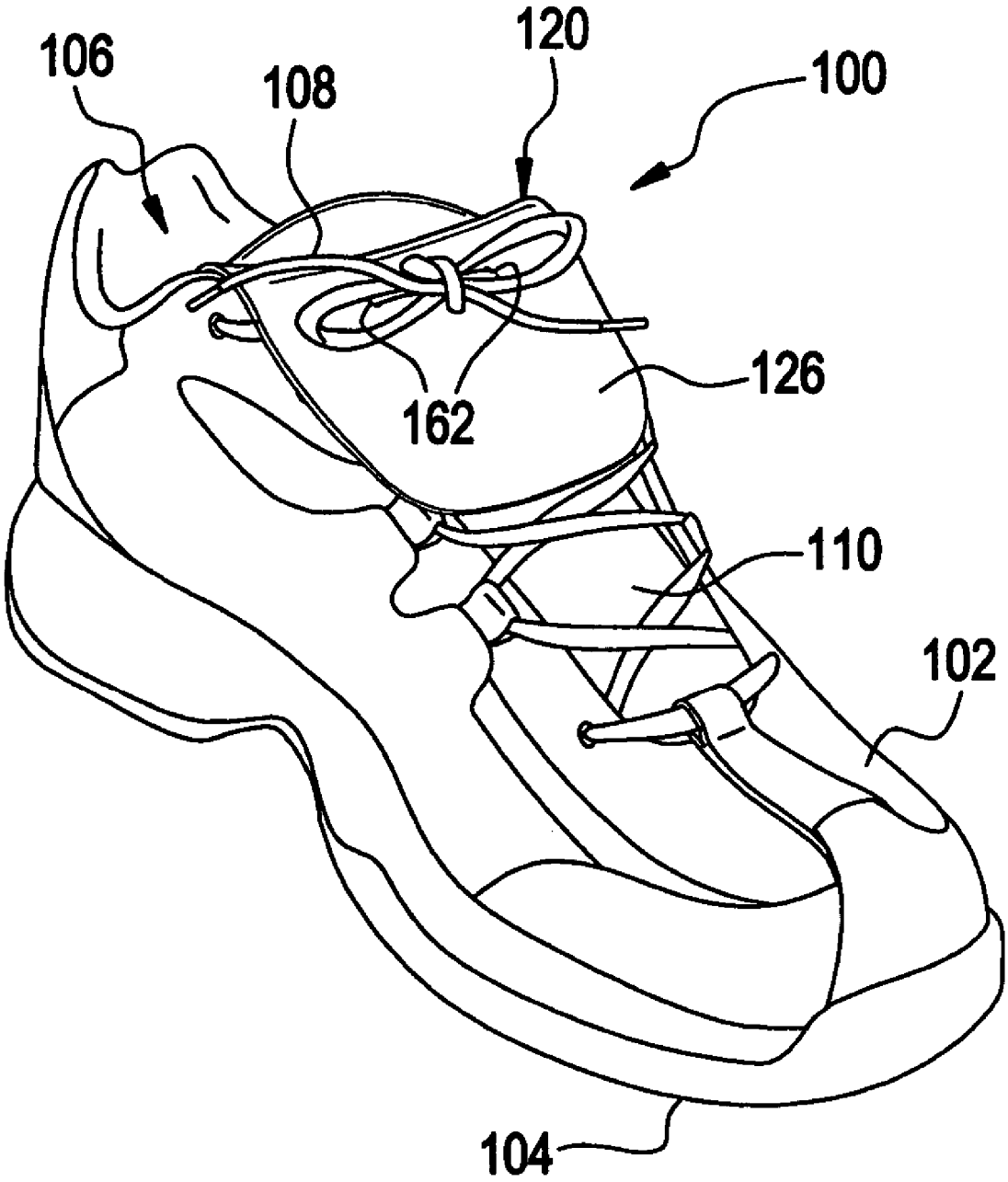
FIG. 4 illustrates a view of the example piece of footwear of FIGS. 1 and 2 with the cover member removably engaged with the tongue member and with the closure system.

In at least some examples, the cover member 120 may engage with the closure system in still another way. As illustrated in FIGS. 1 and 2, the cover element 126 may include one or more holes 162 defined therein. If desired, the ends of the shoe lace 108 may extend through these holes 162, as shown in FIG. 4, and the lace 108 may be tied outside the cover member 120. Alternatively, if the user prefers to have the tie arrangement covered, the lace 108 can be maintained under the cover element 126, as shown in FIG. 3.

Of course, if desired, the engagement element included as part of the tongue member 110 may include the slidable insert and the engagement element included as part of the cover member 120 may include a pocket or material flap without departing from the invention. Additionally, any other suitable or desired way of engaging the cover member 120 with the tongue member 110 may be used without departing from this invention.

As noted above, aspects of the invention allow users to freely decide whether they wish to include a closure system cover member 120 with their footwear (or other foot-receiving devices), and they can change they minds and change the aesthetic appearance of the footwear over time. For example, a person may freely decide to wear the shoes without a cover member 120 (as shown in FIG. 1 with the cover member 120 out of the pocket 112) or with a cover member (in various arrangements as shown in FIGS. 2–4). While removable, the inclusion of various fastening and securing elements as described above allows the cover member 120 to be securely engaged with the footwear such that it will not inadvertently fall off the shoe, even during aggressive play.

As another potential advantage or use, team members could wear a common style of footwear products according to the invention, and they could change the color, style, or other aesthetic characteristics of the cover member to match one another (e.g., wear one color for home games and a different color for away games). As another example, players or teams may wear special cover members to commemorate special people, games, or events, such as cover members including a special or former coach's or player's name, a bowl game or championship game logo, a sponsor's logo, etc. Any desired information, logos, or other indicia may be included on the cover members and/or the free ends of the tongue members without departing from the invention.

D. Conclusion

Various examples of the present invention have been described above, and it will be understood by those of ordinary skill that the present invention includes within its scope all combinations and subcombinations of these examples. Additionally, those skilled in the art will recognize that the above examples simply exemplify the invention. Various changes and modifications may be made without departing from the spirit and scope of the invention, as defined in the appended claims.

The invention claimed is:

1. A foot-receiving device, comprising:

a housing member at least partially defining a chamber for receiving a foot;

a closure system for at least partially holding the foot in the chamber;

a tongue member located between at least a portion of the closure system and the foot when the foot is held in the housing member, wherein the tongue member includes a first engagement element, and wherein the first engagement element includes a pocket defined in or provided on the tongue member; and a cover member for at least partially covering the closure system, wherein the cover member includes a second engagement element that engages with the first engagement element to removably engage the cover member with the tongue member, wherein the second engagement element is at least partially slidably receivable in the pocket.

2. A foot-receiving device according to claim 1 wherein the cover member further includes a cover element extending from the second engagement element, wherein the cover element includes a free end that extends so as to at least partially cover the closure system.

3. A foot-receiving device according to claim 2, wherein the closure system includes a shoe lace, and the cover element includes a pair of openings defined therein, wherein a first end of the shoe lace extends through a first opening of the pair and a second end of the shoe lace extends through a second opening of the pair to releasably engage the cover member with the closure system.

4. A foot-receiving device according to claim 1 wherein the cover member further includes a first securing mechanism that engages with at least a portion of the closure system.

5. A foot-receiving device, comprising:

a housing member at least partially defining a chamber for receiving a foot;

a closure system for at least partially holding the foot in the chamber;

a tongue member located between at least a portion of the closure system and the foot when the foot is held in the housing member, wherein the tongue member includes a first engagement element; and a cover member for at least partially covering the closure system, wherein the cover member includes a second engagement element that engages with the first engagement element to removably engage the cover member with the tongue member, wherein the cover member further includes a cover element extending from the second engagement element, wherein the cover element includes a free end that extends so as to at least partially cover the closure system, and wherein the cover element includes a first fastener element that engages with a second fastener element provided on the tongue member so as to releasably secure the cover element to the tongue member.

6. A foot-receiving device, comprising:

a housing member at least partially defining a chamber for receiving a foot;

a closure system for at least partially holding the foot in the chamber;

a tongue member located between at least a portion of the closure system and the foot when the foot is held in the housing member, wherein the tongue member includes a first engagement element, and wherein the tongue member further includes a first securing mechanism that engages with at least a portion of the closure; and a cover member for at least partially covering the closure system, wherein the cover member includes a second engagement element that engages with the first engagement element to removably engage the cover member with the tongue member, and wherein the cover member further includes a second securing mechanism that engages with at least a portion of the closure system.

7. A foot-receiving device according to claim 6, wherein the closure system includes a shoe lace; wherein the first securing mechanism includes a first pair of openings defined in the cover member, wherein the shoe lace extends through the first pair of openings; and wherein the second securing mechanism includes a second pair of openings defined in the tongue member, wherein the shoe lace extends through the second pair of openings.

8. A foot-receiving device according to claim 7, wherein the first pair of openings is located adjacent to the second pair of openings when the first securing mechanism and the second securing mechanism are engaged with the closure system.

9. A piece of footwear, comprising:

a sole member;

an upper extending from the sole member, wherein the upper at least partially defines a chamber for receiving a foot;

a closure system for at least partially holding the foot in the chamber;

a tongue member located between at least a portion of the closure system and the foot when the foot is held in the chamber, wherein the tongue member includes a first engagement element, and wherein the first engagement element includes a pocket defined in or provided on the tongue member; and a cover member for at least partially covering the closure system, wherein the cover member includes a second engagement element that engages with the first engagement element to removably engage the cover member with the tongue member, and wherein the second engagement element is at least partially slidably receivable in the pocket.

10. A piece of footwear according to claim 9, wherein the tongue member includes a free end, and wherein the pocket includes an open end located proximate to the free end of the tongue member.

11. A piece of footwear according to claim 9, wherein the cover member further includes a cover element extending from the second engagement element, wherein the cover element includes a free end that extends so as to at least partially cover the closure system.

12. A piece of footwear according to claim 9, wherein the cover member further includes a first securing mechanism that engages with at least a portion of the closure system.

13. A piece of footwear according to claim 9, wherein the piece of footwear is a piece of athletic footwear.

14. A piece of footwear, comprising:

a sole member;

an upper extending from the sole member, wherein the upper at least partially defines a chamber for receiving a foot;

a closure system for at least partially holding the foot in the chamber;

a tongue member located between at least a portion of the closure system and the foot when the foot is held in the chamber, wherein the tongue member includes a first engagement element; and a cover member for at least partially covering the closure system, wherein the cover member includes a second engagement element that engages with the first engagement element to removably engage the cover member with the tongue member, wherein the cover member further includes a cover element extending from the second engagement element, wherein the cover element includes a free end that extends so as to at least partially cover the closure system, and wherein the cover element includes a first fastener element that engages with a second fastener element provided on the tongue member so as to releasably secure the cover element to the tongue member.

15. A piece of footwear, comprising:

a sole member;

an upper extending from the sole member, wherein the upper at least partially defines a chamber for receiving a foot;

a closure system for at least partially holding the foot in the chamber;

a tongue member located between at least a portion of the closure system and the foot when the foot is held in the chamber, wherein the tongue member includes a first engagement element, and wherein the tongue member further includes a first securing mechanism that engages with at least a portion of the closure system; and a cover member for at least partially covering the closure system, wherein the cover member includes a second engagement element that engages with the first engagement element to removably engage the cover member with the tongue member, and wherein the cover member further includes a second securing mechanism that engages with at least a portion of the closure system.

16. A piece of footwear according to claim 15, wherein the closure system includes a shoe lace; wherein the first securing mechanism includes a first pair of openings defined in the cover member, wherein the shoe lace extends through the first pair of openings; and wherein the second securing mechanism includes a second pair of openings defined in the tongue member, wherein the shoe lace extends through the second pair of openings.

17. A piece of footwear according to claim 16, wherein the first pair of openings is located adjacent to the second pair of openings when the first securing mechanism and the second securing mechanism are engaged with the closure system.

18. A piece of footwear, comprising:

a sole member;

an upper extending from the sole member, wherein the upper at least partially defines a chamber for receiving a foot;

a closure system for at least partially holding the foot in the chamber;

a tongue member located between at least a portion of the closure system and the foot when the foot is held in the chamber, wherein the tongue member includes a first engagement element, and wherein the first engagement element includes a pocket defined in or provided on the tongue member; and a cover member that includes; (a) a second engagement element that engages with the first engagement element to removably engage the cover member with the tongue member; (b) a cover element that extends from the second engagement element, wherein the cover element includes a free end that extends to at least partially cover the closure system, and wherein the second engagement element is at least partially slidably receivable in the pocket; and (c) a first securing mechanism that engages with at least a portion of the closure system.

19. A piece of footwear according to claim 18 wherein the first securing mechanism forms part of the second engagement element.

20. A piece of footwear, comprising:

a sole member;

an upper extending from the sole member, wherein the upper at least partially defines a chamber for receiving a foot;

a closure system for at least partially holding the foot in the chamber;

a tongue member located between at least a portion of the closure system and the foot when the foot is held in the chamber, wherein the tongue member includes a first engagement element; and a cover member that includes; (a) a second engagement element that engages with the first engagement element to removably engage the cover member with the tongue member; (b) a cover element that extends from the second engagement element, wherein the cover element includes a free end that extends to at least partially cover the closure system, and wherein the cover element includes a first fastener element that engages with a second fastener element provided on the tongue member so as to releasably secure the cover element to the tongue member; and (c) a first securing mechanism that engages with at least a portion of the closure system.

21. A piece of footwear, comprising:

a sole member;

an upper extending from the sole member, wherein the upper at least partially defines a chamber for receiving a foot;

a closure system for at least partially holding the foot in the chamber;

a tongue member located between at least a portion of the closure system and the foot when the foot is held in the chamber, wherein the tongue member includes a first engagement element, and wherein the tongue member further includes a first securing mechanism that engages with at least a portion of the closure system; and a cover member that includes; (a) a second engagement element that engages with the first engagement element to removably engage the cover member with the tongue member; (b) a cover element that extends from the second engagement element, wherein the cover element includes a free end that extends to at least partially cover the closure system; and (c) a second securing mechanism that engages with at least a portion of the closure system.

22. A piece of footwear according to claim 21, wherein the closure system includes a shoe lace; wherein the first securing mechanism includes a first pair of openings defined in the cover member, wherein the shoe lace extends through the first pair of openings at least one time; and wherein the second securing mechanism includes a second pair of openings defined in the tongue member, wherein the shoe lace extends through the second pair of openings at least one time.

23. A piece of footwear according to claim 22, wherein the first pair of openings is located adjacent to the second pair of openings when the first securing mechanism and the second securing mechanism are engaged with the closure system.

24. A piece of footwear according to claim 22, wherein the shoe lace extends through the first pair of openings at least two times, and wherein the shoe lace extends through the second pair of openings at least two times.

25. A method, comprising:

providing a foot-receiving device including a housing member that at least partially defines a chamber for receiving a foot, a closure system, and a tongue member;

removably engaging a first engagement element of the tongue member with a second engagement element provided with a cover member for the closure system, wherein the first engagement element includes a pocket defined in or provided with the tongue member, and wherein the engaging includes sliding at least a portion of the second engagement element into the pocket; and placing a cover element of the cover member over at least a portion of the closure system to thereby at least partially cover the closure system.

26. A method according to claim 25, further comprising:

releasably securing the cover element to the tongue member.

27. A method according to claim 26, wherein the releasably securing includes engaging a first fastener element provided on the cover element with a second fastener element provided on the tongue member.

28. A method according to claim 25, further comprising:

releasably engaging the cover member with at least a portion of the closure system.

29. A method according to claim 28, wherein the releasably engaging the cover member with the closure system includes extending a first end of a shoe lace of the closure system through a pair of openings defined in the cover member and extending a second end of the shoe lace through the pair of openings.

30. A method according to claim 25 further comprising:

disengaging the cover member from the tongue member.

31. A method according to claim 25, wherein the foot-receiving device is a piece of footwear.

32. A method, comprising:

providing a foot-receiving device including a housing member that at least partially defines a chamber for receiving a foot, a closure system, and a tongue member;

removably engaging a first engagement element of the tongue member with a second engagement element provided with a cover member for the closure system;

placing a cover element of the cover member over at least a portion of the closure system to thereby at least partially cover the closure system;

releasably engaging the cover member with at least a portion of the closure system; and releasably engaging the tongue member with at least a portion of the closure system.

33. A method according to claim 32, wherein the releasably engaging the cover member with the closure system includes extending a first end of a shoe lace of the closure system through a first pair of openings defined in the cover member and extending a second end of the shoe lace through the first pair of openings, and wherein the releasably engaging the tongue member with the closure system includes extending the first end of the shoe lace through a second pair of openings defined in the tongue member and extending the second end of the shoe lace through the second pair of openings.

34. A method according to claim 33, wherein the first pair of openings are located adjacent to the second pair of openings when the cover member and the tongue member are engaged with the closure system.

* * * * *